United States Patent [19]

Yoshikawa et al.

[11] 4,019,419

[45] Apr. 26, 1977

[54] TUNING DEVICE

[75] Inventors: Haruzo Yoshikawa; Keiji Shimano; Noritoshi Oishi, all of Oyama, Japan

[73] Assignee: Kabushiki Kaisha Daini Seikosha, Japan

[22] Filed: May 27, 1975

[21] Appl. No.: 580,789

[30] Foreign Application Priority Data

May 24, 1974 Japan ..... 49-58618

[52] U.S. Cl. ..... 84/454; 84/1.01; 324/79 R

[51] Int. Cl.[2] ..... G10G 7/02

[58] Field of Search ..... 84/454, 1.01, 1.03; 324/79 R, 79 D, 82, 83 D, 78 R, 78 D; 331/47; 307/265

[56] References Cited

UNITED STATES PATENTS

| | | | |
|---|---|---|---|
| 2,751,446 | 6/1956 | Bopp | 330/29 |
| 2,924,776 | 2/1960 | Peterson | 84/454 X |
| 2,958,250 | 11/1960 | Poehler | 84/454 |
| 3,509,454 | 4/1970 | Gossel | 84/454 X |
| 3,696,293 | 10/1972 | Hoffmann et al. | 324/79 D |
| 3,702,370 | 11/1972 | Hallman, Jr. | 84/1.01 |
| 3,743,756 | 7/1973 | Franssen et al. | 84/1.03 X |
| 3,861,266 | 1/1975 | Whitaker | 84/454 |
| 3,879,684 | 4/1975 | Sanderson | 331/111 |
| 3,901,120 | 8/1975 | Youngquist | 84/454 |

*Primary Examiner*—Ulysses Weldon
*Attorney, Agent, or Firm*—Robert E. Burns; Emmanuel J. Lobato; Bruce L. Adams

[57] ABSTRACT

A tuning device for musical instruments or voices comprises a visual stroboscopic displaying means which displays a light flow at a speed proportional to the difference of a tone to be tuned from the signal of the corresponding standard pitch. A standard pitch in a predetermined octave is synthesized from pulses generated by a high frequency oscillator the standard pitch and is divided into a pitch in a predetermined lower octave for comparing the tone to be tuned in the stroboscopic displaying means. The tone to be tuned is also divided into a signal of a pitch in the lower octave and it is transmitted to the stroboscopic displaying means.

The stroboscopic display means compares the signal to be tuned with the standard signal, making a light-flow display by overlapping both the signals. The pitch and octave of the tone to be tuned is previously set on the device with a manual selector switch.

14 Claims, 19 Drawing Figures

TUNING DEVICE

BRIEF SUMMARY OF THE INVENTION

The present invention relates to a tuning device for musical instruments or voices and having means to display the pitch discrepancy of a tone to be tuned from the corresponding standard tone, and to generate an audible tone of a standard pitch.

The principal object of the present invention is to provide a tuning device for musical instruments or voices and which has visual stroboscopic displaying means so that even a beginner can make easy and exact tuning.

It is another object of this invention to provide a tuning device for musical instruments or voices and which has pitch shifting means for shifting standard pitch signals so that tuning to a little higher-frequency than the standard, i.e., tuning suitable for a concert, can be made.

DETAILED DESCRIPTION OF THE PREFERRED EMBODIMENT

Figure 1:
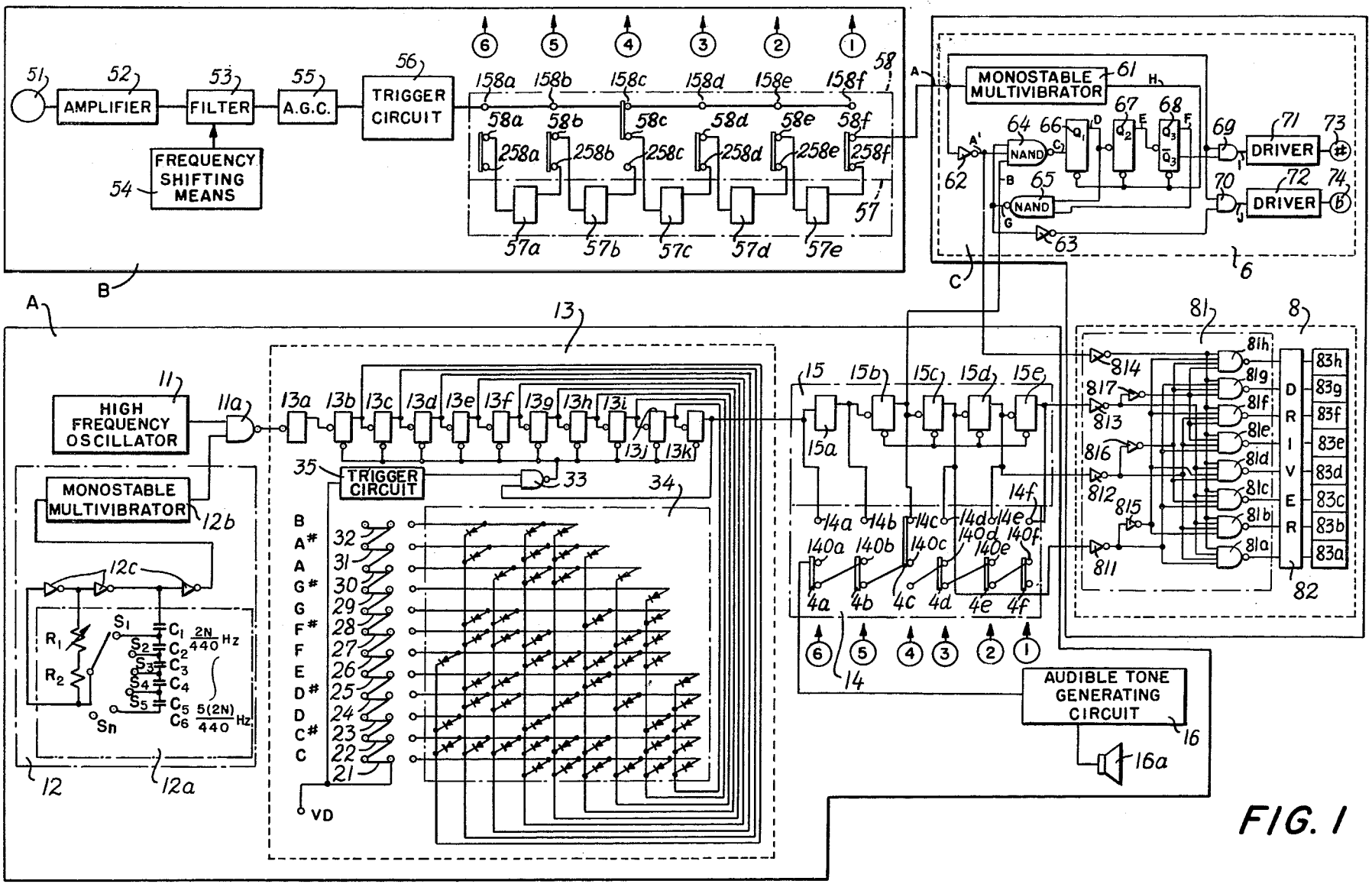
FIG. 1 is a combined block diagram and circuit diagram showing an embodiment of this invention.

In the accompanying drawings, FIG. 1 shows a tuning device constructed according to the principles of this invention, which comprises a standard pitch generating circuit A, a tone-electric pulse transducing circuit B which collects tones to be tuned to transduce them into electric pulses and an indicating device C to display the degree by which the tone differs from the standard pitch.

The standard pitch generating circuit A comprises a high frequency oscillator 11 such as a quartz oscillator of 4.3005 MHz, a pitch shifting circuit 12 to mix some pulses for pitch shifting into the pulses generated by the high frequency oscillator 11, a synthesizer 13 to synthesize pulses of a desired pitch in a higher octave from the high frequency pulses generated by the oscillator, octave selecting switches 14 to lower the standard pitch in the higher octave to the corresponding pitch in the selected octave, an octave divider unit 15 to divide the desired pitch pulses in the higher octave into pulses having a frequency corresponding to a pitch lower by the desired octaves than the pitch in the higher octave, and an audible tone generating circuit 16 to transduce the divided pitch standard signal from a selected divider output into a tone of this pitch.

The pitch shifting circuit 12 comprises an oscillator 12*a*, a monostable multivibrator 12*b* and a series of inverters 12*c*. The RC oscillator 12*a* has a variable resistor $R_1$ and a fixed resistor $R_2$ connected in series to first inverter 12*c*, and connected in parallel with a series of condensers $C_1$–$C_5$, an end thereof being connected to a line between a second inverter $12c_2$ and the third inverter $12c_3$, and a rotary switch S for selecting the desired connection of the first inverter input terminal to one of the condenser terminals or open state.

The condensers are equal in capacity with each other so that oscillating frequency of the RC oscillator 12*a* is changeable step by step from 0 to 2N/440, 2(2N)/440 ... 5(2N)/440 Hz with turning of the select switch S. N. in the above frequency expressions is adjusted to be equal with the frequency of the high frequency oscillator 11. Output pulses of $n$(2N)/440 Hz from the monostable multivibrator 12*b* are transmitted to a NAND gate 11*a*, each of the pulses arriving between pulses from the high frequency oscillator 11. Therefore, it is preferable to make the output pulse sharp when the pulses $P_3$ (in FIG. 3) from the NAND gate 11*a* are used to shift to a little higher pitch.

The synthesizer 13 comprises eleven flip-flop circuits 13*a* to 13*k* in series, select switches 21 to 32 for 12 tones C–B in chromatic scale, a diode matrix 34 each column thereof being connected to an output terminal of one of the flip-flop circuits 13*b* to 13*j*, a NAND gate 33 for resetting the flip-flop circuits 13*b* to 13*k*, and a Schmidt trigger circuit 35, the output thereof being connected to an input of the NAND gate 33 to transmit Schmidt trigger pulses thereto.

Each row of the diode matrix 34 is connected to one of the select switches 21 to 32. The input terminal of the flip-flop circuit 13*a* is connected to the output of the NAND gate 11*a*, while the output terminal of the flip-flop circuit 13*k* is connected to the other input terminal of the NAND gate 33 and to the octave divider circuit 15. The common contact terminal of each of the select switches 22 to 32 is connected to the normally closed contact terminal of the adjacent select switch. The common contact terminal of the select switch 21 and the input terminal of the Schmidt trigger circuit 35 are connected to a D.C. source.

As the pitch synthesizer 13 is of well-known construction, the details of its operation are omitted. For example, when the select switch 21 is pushed on, pitch C in a higher octave, e.g. C6 of 1046.5Hz, is synthesized therein and transmitted from the output of the flip-flop 13*k* to the octave divider circuit 15.

The octave selecting switch 14 has a set of six switching elements. The normally open contact terminal 14*a*, 14*b* ... or 14*f* of each switching element is connected to the output of one of the flip-flop circuits 13*k*, 15*a*, 15*b*, 15*c*, 15*d* and 15*e*. Each common contact terminal 140*b*, 140*c*, 140*d*, 140*e* or 140*f* is connected to the normally closed contact terminal of one of the adjacent switching elements, the common contact terminal 140*a* being connected to the audible tone generating circuit 16. The octave divider unit 15 has five dividers 15*a*, 15*b*, 15*c*, 15*d* and 15*e* in series, the input terminal of the divider 15 being connected to the output of the synthesizer 13. Therefore, the synthesizer output, e.g. of C6 is divided step by step into the corresponding pitch in the next lower octave, e.g. C5 of 523.25 Hz at the output of the divider 15*a*, C4 of 261.63 Hz at 15*b*, C3 of 130.81 Hz at 15C, C2 of 65.41 Hz at 15*d* and C1 of 32.7 Hz at 15*e*.

When the switching element 4*c* is switched on as shown in FIG. 1, a signal of pitch C4 is transmitted to the audible tone generating circuit 16, so that a tone of C4 (261.63 Hz) is given from the loud-speaker 16*a* of the circuit 16.

Figure 2:
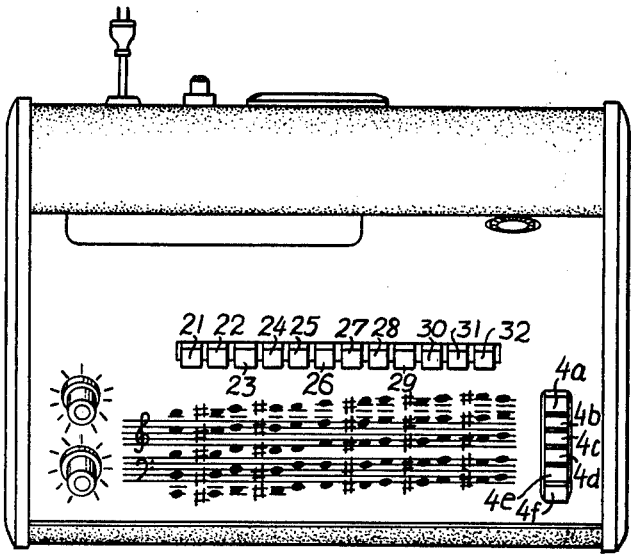
FIG. 2 is a plan view showing the select switch panel of the embodiment.

The octave selecting switches 4*a*, 4*b* . . . 4*f* and the pitch selecting switches 21, 22 . . . 32 are preferably arranged in a matrix form as in FIG. 2, with the pitch selecting switches in a transverse line and the octave selecting switches in a vertical line, representing a musical score on the cross area thereof with each note therein in correspondence to both of a switch in the traverse line and one in the vertical line.

Pitch shifting of an output from the synthesizer 13 will be now described.

Pitch shifting often used in orchestra concerts is a little higher shifting. For example, a pitch of 441 to 445 Hz is selected for shifted pitch A4 while the standard pitch of A4 is 440 Hz.

Figure 3:
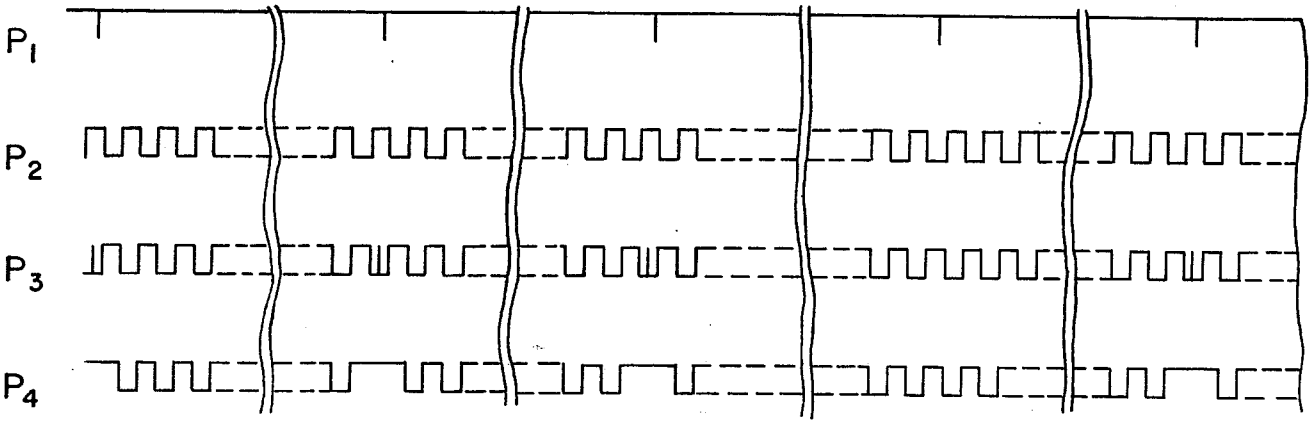
FIG. 3 is a waveform chart showing pitch control pulses mixing high frequency waves from a quartz oscillator.

When 441 Hz should be selected for A4, the select switch S is switched onto the terminal $S_1$ as is shown in FIG. 1, so that the output pulses from the monostable multivibrator 12*b* become P, in FIG. 3, having a frequency of 2N/440 Hz. These pulses should be as narrow as possible. If these pulses are wider than those $P_2$ from the high frequency oscillator 11, they are apt to mask the latter pulses $P_2$ making output $P_4$ in FIG. 3 at the NAND gate 11*a* and accordingly decreasing high the number of frequency pulses.

Narrower pulses $P_1$ are with probability so mixed into high frequency pulses $P_2$ from the high frequency quartz oscillator 11 that the output of the NAND gate 11*a* becomes a series of pulses $P_3$ having a frequency of $$\left(N+\frac{N}{440}\right)\text{Hz.}$$

The reason why the frequency becomes $$\left(N+\frac{N}{440}\right)\text{Hz}$$

is that the pulse form of the pulses $P_2$ is symmetrized with equal width of a high level and a low level, a pulse of $P_1$ falling in high levels or low levels of the pulses $P_2$ with equal probability, and when a pulse of $P_1$ is placed in correspondence with a high level of $P_2$, one pulse is added to $P_3$, while no pulse is added when it is placed in correspondence with a low level.

The frequency N Hz of the pulses from the high frequency oscillator 11 is so adjusted that the synthesized frequency is 1760 Hz when the select switch 30 is switched on for pitch A, the frequency of the pulses at the octave divider output 15*b* being 440 Hz. These 1760 Hz and 440 Hz frequencies are respectively proportional to the N Hz. Therefore, when N is shifted to $$N\left(1+\frac{1}{440}\right),$$

440 Hz of A4 is also shifted to 441 Hz. This results in shifting the audible tone of 440 Hz from the loud-speaker 16*a* to that of 441 Hz.

The terminal $S_2$ of the select switch S is for a pitch shift of ratio 442/440, S3 for 443/440, S4 for 444/440 and S5 for 445/440.

If a little lower pitch shift is required, it is preferable to make the output pulse of the pitch shifting circuit 12 have a width of 1.5 times of that the high frequency pulse from the high frequency oscillator. In this case, a pitch shifting pulse fills a gap between a pair of high frequency pulses adjoining each other with 50% probability, shifting the high frequency pulses a little lower. This probability permits the pitch shifting pulse output to also take $n$(2N)/440 Hz.

The tone-electric pulse transducing circuit B will be now described hereinafter.

This transducing circuit B produces a series of pulses suitable to be compared with standard frequency pulses, which will be described later, from received audible tones.

The tone-electric pulse transducing circuit B comprises a tone detector 51 such as a microphone or a pick-up to receive tones from musical instruments or voices to be tuned, an amplifier 52 connected to the tone detector 51, a filter 53 to only pass the fundamental waves in the tone signal from the amplifier 52 thereby eliminating the harmonic waves and noise, filter band or cut-off frequency shifting means 54 having a set of switches (not shown) cooperating with the octave select switches 14*a*, 14*b* . . . 14*f* to shift the filter band or cut-off frequency by an octave which includes the tone to be tuned, an automatic gain-controller (A.G.C.) 55 to control the filter output within a predetermined gain level, a Schmidt trigger circuit 56 to shape the wave forms of the A.G.C. output, octave dividers 57 to divide the output pulses of the Schmidt trigger circuit 56, and an octave select switch unit 58 coacting with the former octave select switches 4*a*, 4*b*, . . . 4*f* to select dividing number of the dividers 57.

Figure 1A:
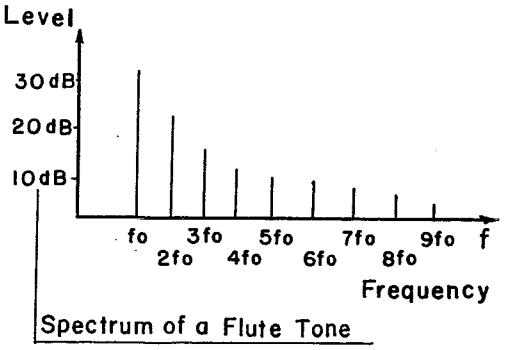
FIG. 1*a* is a graph showing the spectrum of a flute tone.
Figure 1B:
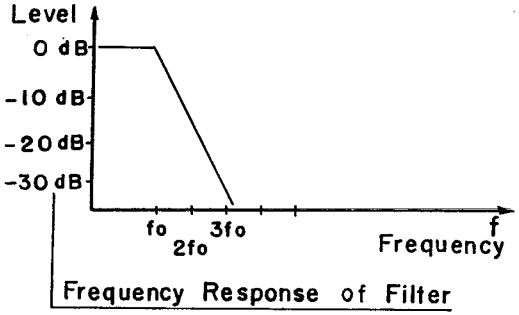
FIG. 1*b* is a graph showing the frequency response of a filter for tones to be tuned.
Figure 1C:
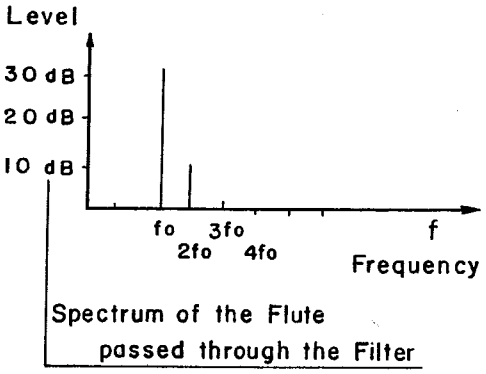
FIG. 1*c* is a graph showing the spectrum of the flute tone passed through the filter.
Figure 1D:
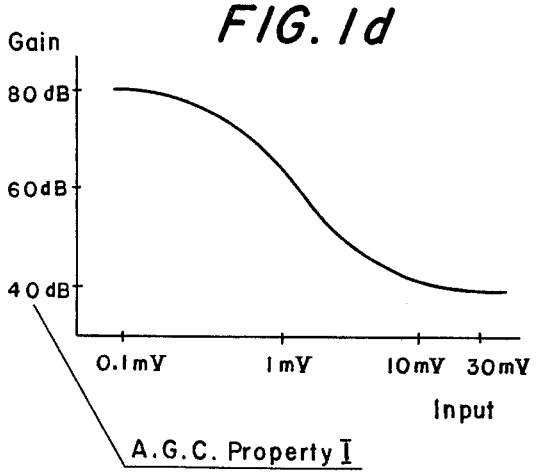
FIGS. 1*d* and 1*e* are graphs showing certain characteristics of an automatic gain-controller A.G.C. used for tones to be tuned.

A flute tone, for example, is treated in the following manner. FIG. 1*a* shows a spectrum of a flute tone, with *fo* representing the fundamental tone, 2*fo* representing a harmonic wave of twice the frequency as the fundamental, 3*fo* three times, . . . . This spectrum is changed to a spectrum with higher frequency harmonics decreased to nearly zero level, as is shown in FIG. 1*c*, after passing through the filter 53 which characteristics curve is in this case set as in FIG. 1*b*. FIG. 1*d* shows a characteristic curve of the A.G.C. 55, wherein the range of the microphone output level is approximately from 0.1mV to 30mV. Therefore, wide range of the microphone output level, i.e. wide range of the sound level of the tone to be tuned, is compensated to be a suitable level as is shown in FIG. 1*e* for treating in the following circuits.

Figure 1F:
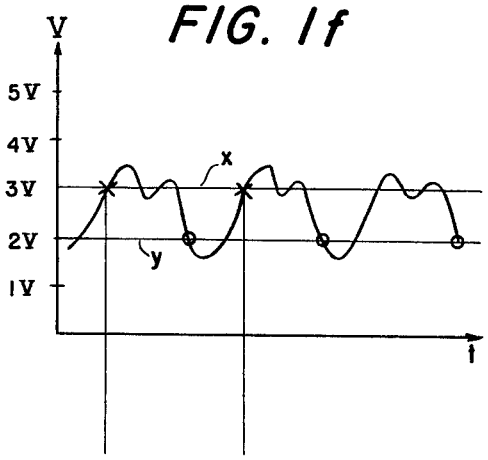
FIG. 1*f* is a waveform chart showing waves the output of the A.G.C. of the flute tone.
Figure 1E:
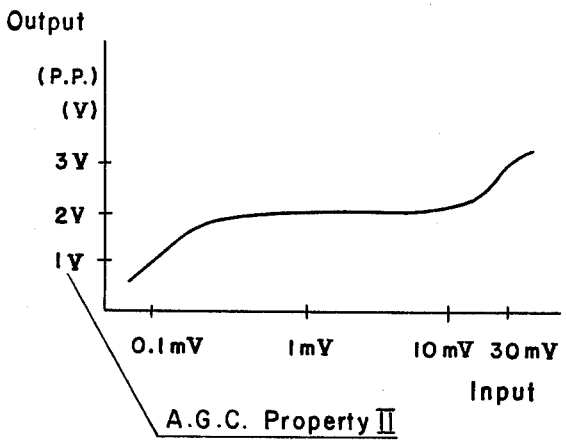
Figure 1G:
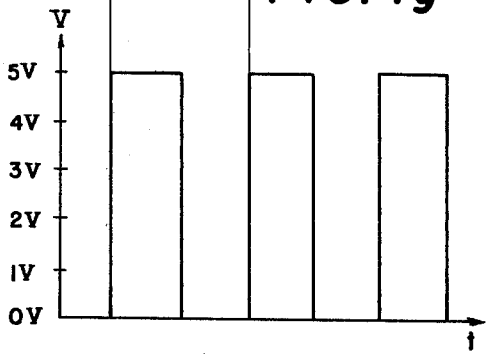
FIG. 1*g* is a waveform chart showing rectangular waves modified by a Schmidt trigger circuit, corresprending to those in FIG. 1*f*.

The A.G.C. output, the wave form of which is shown in FIG. 1*f*, is shaped through the Schmidt trigger circuit 56. A Schmidt level for input increasing is set at $x$V, while that for input decreasing is set at $y$V which is lower than $x$V as shown in FIG. 1*f*. The output of the Schmidt trigger circuit is thus shaped into an oblong shape as shown in FIG. 1*g*.

The octave select switch unit 58 has six select switches 58*a*, 58*b* . . . 58*f* each of which cooperates with a select switch having a corresponding alphabetical reference mark in the former octave select switch unit 14. Each normally open switching terminal 158*a*, 158*b* . . . 158*e* or 158*f* is connected in common to the output of the Schmidt trigger circuit 56 and each common switching terminal 58*a*, 58*b*, 58*c*, 58*d* or 58*e* is connected to the input of a respective divider 57*a*, 57*b*, 57*c*, 57*d* or 57*e* in the octave divider unit 57. The common switching terminal 58*e* of the last switch 58*e* is connected to the indicating equipment C, the normally closed switching terminals 258*a*, 258*b*, 258*c*, 258*d* and 258*e* are respectively connected to the output terminals of the dividers 57*a*, 57*b*, 57*c*, 57*d* and 57*e*.

When C4 to B4 range is selected on the octave select switch unit 58 with the former octave unit 14, the switching terminal 158*c* is connected to the common terminal 58*c* as is well shown in FIG. 1, opening the switching terminal 258*c*, so that the three dividers 57*c*, 57*d* and 57*e* are connected in series between the Schmidt trigger circuit 56 and the indicating equipment C. Therefore, the input of the indicating equipment C is made, in this case, three octaves lower in frequency than the fundamental frequency of the tone received by the microphone 51.

If the tone is nearly C4 of 261.63 Hz, the input signal to the indicating equipment C becomes nearly C1 of 32.7 Hz in frequency.

If the tone is nearly C6 of 1046.5 Hz, the input signal is also nearly C1 of 32.7 Hz, because the octave select switch unit 58 is to be manualy changed, the switch 58*a* being switched on in turn.

Thus, the tones received by the tone detector 51 are always changed into oblong pulse trains of the lowest frequency range C1 to B1.

The indicating equipment C will be described hereinafter referring to FIGS. 3 to 11.

The indicating equipment C has a sharp-flat indicating circuit 6 to coarse or roughly indicate the large difference of the output signal frequency of the tone-electric pulse transducing circuit B from that of the standard pitch generating circuit A, energizing a sharp mark signal thereof in case the former is higher than the latter and a flat mark signal in case the former is lower, and an electronic stroboscope indicator 8 to finely indicate the little difference between the former and the latter in a light-line flow, the flow being stopped when the former is quite coincident to the latter.

The sharp-flat indicating circuit 6 comprises a NAND gate 64 having three input terminals, one of the input terminals being connected to the whole input terminal of the sharp-flat indicating circuit 6 through an inverter 62, three flip-flop circuits 66, 67 and 68 connected in series to the output terminal of the NAND gate 64, these circuits 66, 67 and 68 being connected in a manner that the clock input terminal of the first flip-flop 66 is connected to the output of the NAND gate 64 and that the output terminals $Q_1$ and $Q_2$ of the flip-flops 66 and 67 are respectively connected to their next flip-flop clock input, a monostable multivibrator 61 connected in parallel with the inverter 62, the output terminal thereof being connected to each reset terminal of the flip-flop circuits, a NAND gate 65 having two input terminals thereof being connected respectively to the output terminal Q of the first flip-flop circuit 66 and to that of the last flip-flop circuit 68, the output side of the latter inverter 65 being connected to another input terminal of the monostable multivibrator 64, two AND gates 69 and 70 to transmit signals respectively to drivers 71 and 72, each of these gates having an input terminal connected in common directly to the output terminal of the tone-electric pulse transducing circuit B with the other input terminal of the AND gate 69 being connected to the output $\overline{Q}_3$ of the last flip-flop 68 and an inverter 63 to invert the output signal of the NAND gate 65 connected to the other input terminal of the AND gate 70. The two drivers 71 and 72 drive respectively a sharp-indicating lamp 73 and a flat-indicating lamp 74.

The NAND gate 64 has another input terminal which is connected to the output terminal Q of the flip-flop 15*b* in the octave divider unit 15.

The operation of this sharp-flat indicating circuit 6 will be described referring to FIGS. 4, 5, 6 and 7 in which reference marks A, A′, B . . . etc. are corresponding to those in FIG. 1.

A standard pitch B in the fourth octave, e.g. A4 is transmitted from the flip-flop 15*b* to the NAND gate 64, while a pulse train A of a pitch in the first octave, formed in proportion to a tone to be tuned, is transmitted from the octave select switch unit 58 to the monostable multivibrator 61, the AND gates 69 and 70, and the inverter 62 which sends out the inverted pulse train A′ to the NAND gate 64. The flip-flops 66, 67 and 68 are in the initial condition in which each output Q is at 0 level, Q being 1 level, so that the output of the NAND gate 65 is 1 level.

Figure 4:
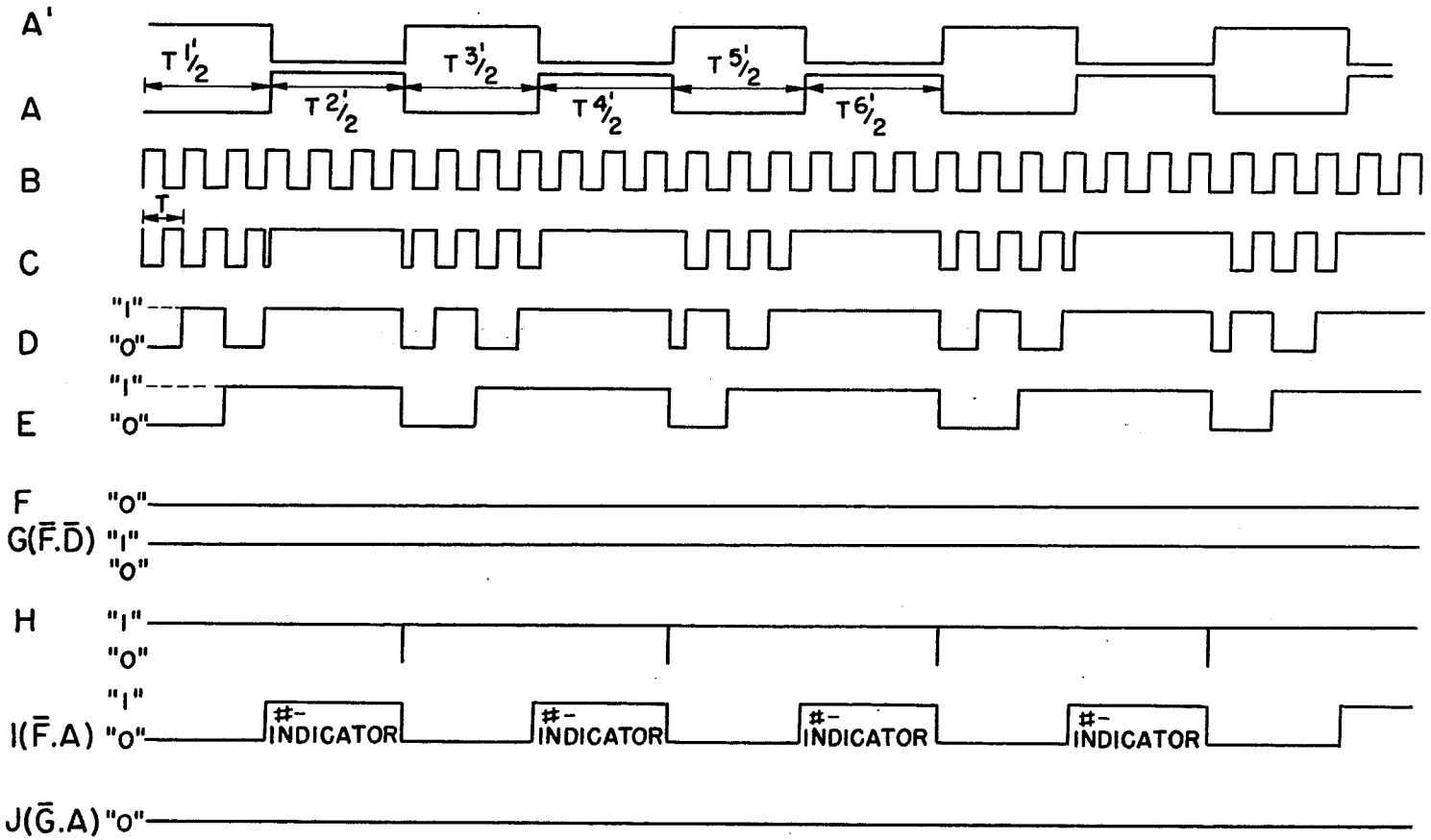
FIGS. 4 to 7 are timing charts showing sharp. flat display principle.
Figure 5:
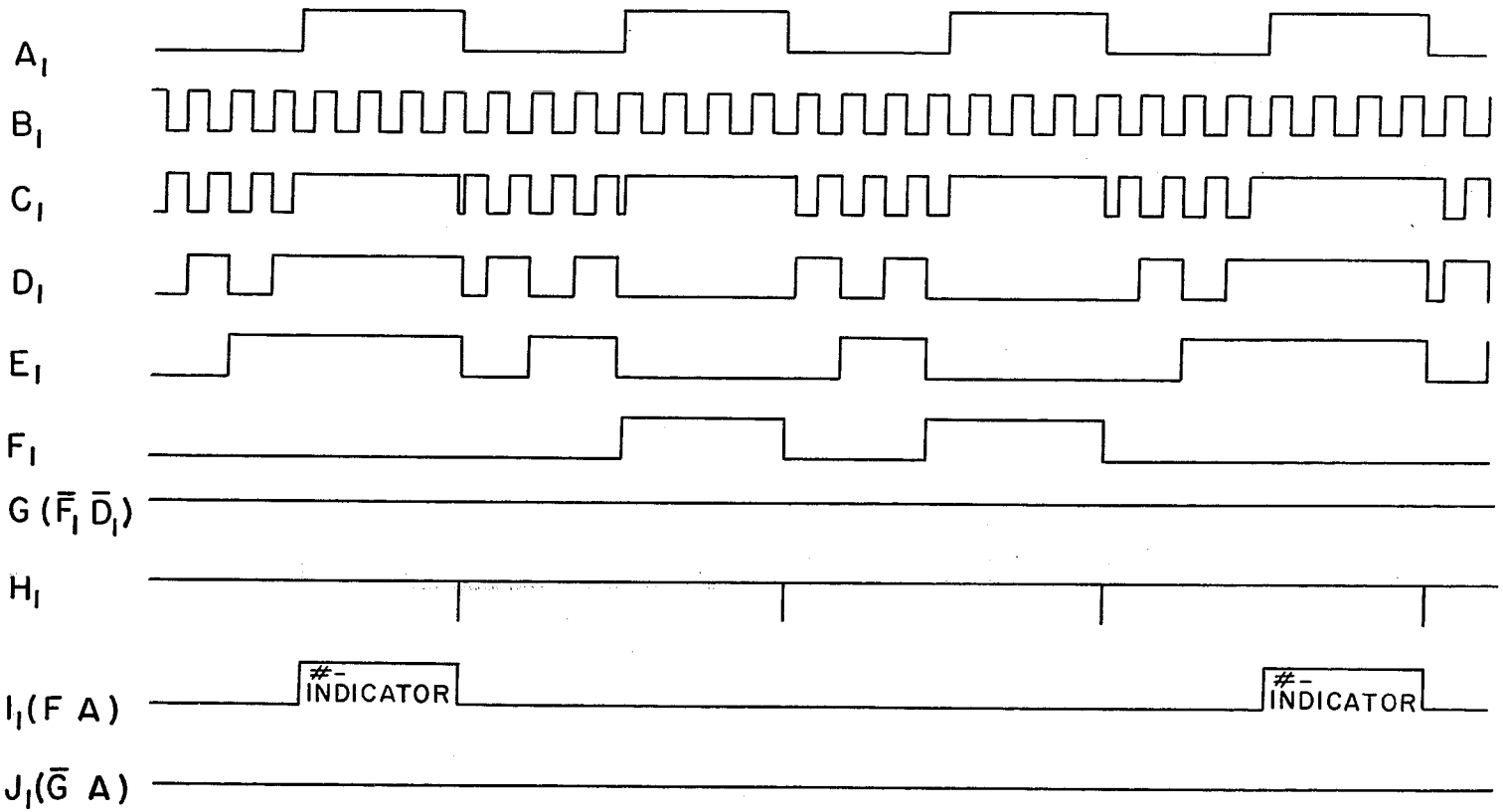
Figure 6:
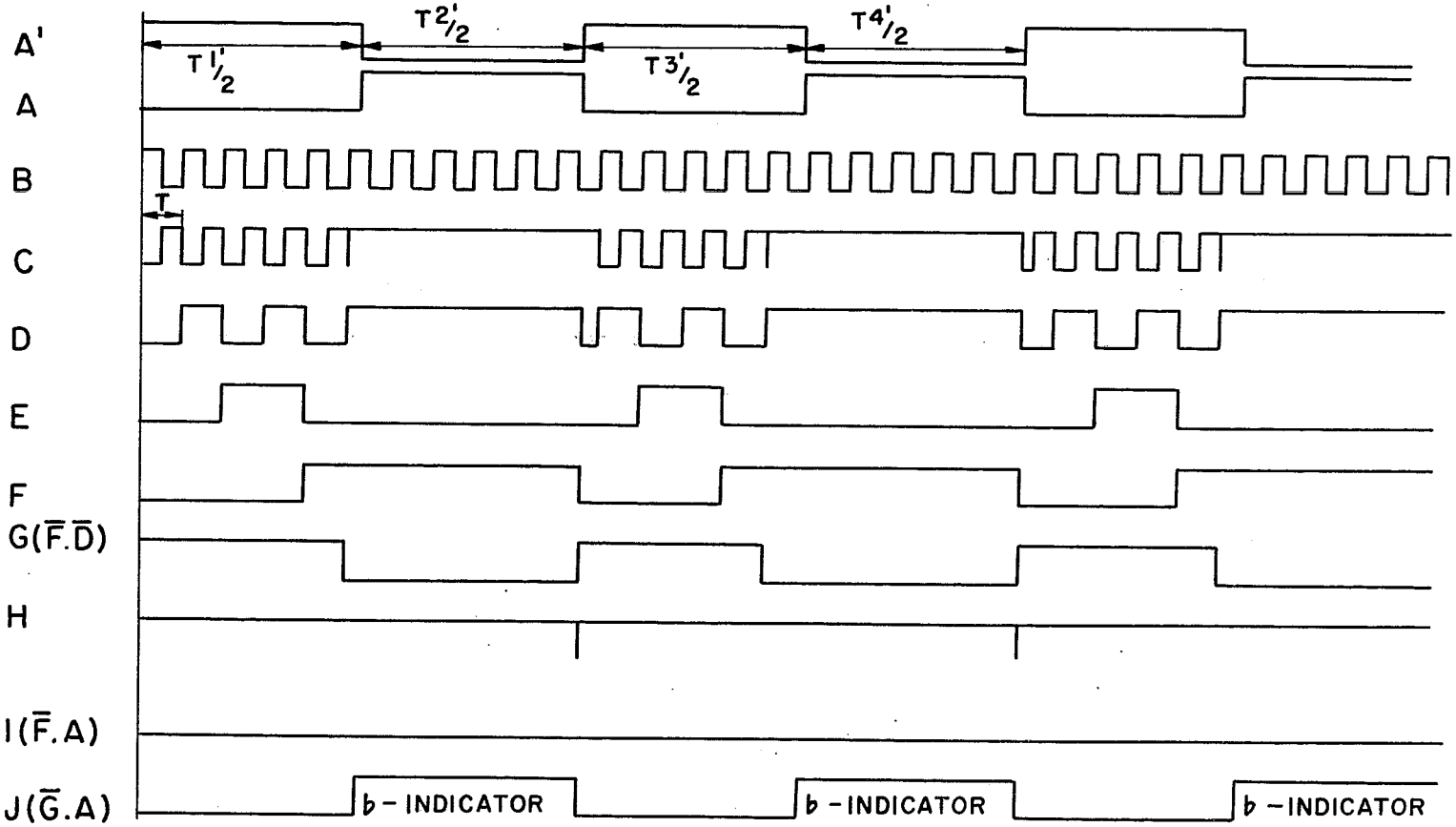
Figure 7:
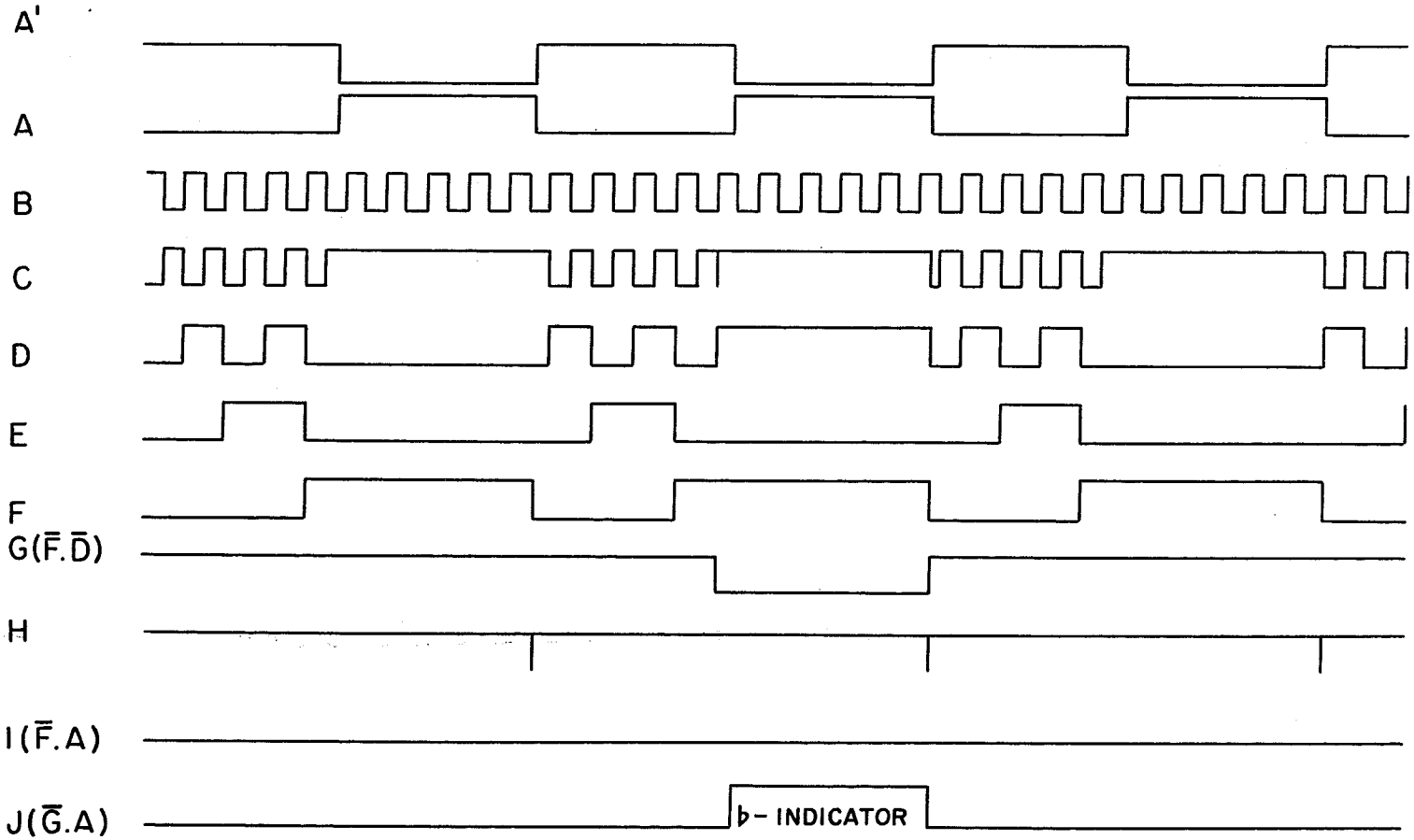

Examples of pulse trains A, A′ and B are illustrated in FIGS. 4, 5, 6 and 7 in which FIG. 4 shows pulse trains of a tone of a higher pitch than the standard A4, FIG. 5 shows those in case of a little pitch, FIG. 6 shows those in case of lower pitch, and FIG. 7 shows those in case of a little lower pitch. The signal of 1 level is transmitted to the NAND gate 64 so that the output at 1 level of the gate 64 is changed to a pulse train which is inverted with respect to the train B when the level of the train A′ becomes 1. Then, the flip-flops 66, 67 and 68 begin to count pulse number of the pulse train C from the gate 64, the outputs $Q_1$, $Q_2$ and $Q_3$ shifting alternately. This counting detail is shown in Table 1.

If the tone to be tuned is much higher in pitch than the selected standard pitch, the width ½ T of a pulse in the train A is made narrower than 3 cycle lengths of the train B, as is shown in FIG. 4, which makes the counting number always less than 4 during a pulse in the train A. It never appears, as shown in Table 1, a combination of $Q_1 = 1$ and $Q_3 = 1$ till the flip-flops count 0 to 3, and, therefore, the output of the NAND gate 65 is kept at 1 level so that the counting pulses are maintained on in C during ½ T of 1 level in A′. In this case, the output $\overline{Q}_3$ is kept alway at 1 level so that the output I of the AND gate 69 is shifted to 1 level every 1 level of A, energizing the sharp indicating lamp 73 intermittently, while the output of the inverter 63 is always at 0 level so that the output J of the AND gate 70 is kept at 0 level. This intermittent lighting does not cause flickering as the cycle of the pulse train A is higher.

Table 1

| Count number | Output terminals $Q_1$ | $Q_2$ | $Q_3$ |
|---|---|---|---|
| 0 | 0 | 0 | 0 |

Table 1-continued

| Count number | Output terminals $Q_1$ | $Q_2$ | $Q_3$ |
|---|---|---|---|
| 1 | 1 | 0 | 0 |
| 2 | 0 | 1 | 0 |
| 3 | 1 | 1 | 0 |
| 4 | 0 | 0 | 1 |
| 5 | 1 | 0 | 1 |

Thus, it is indicated with continuous lighting of the sharp indicating lamp that the tone to be formed is far higher than the standard in pitch.

If the tone is near to but a little higher in pitch than the standard and the width ½T of a pulse in the train A is wider than 3 cycle but narrower than 4 cycle lengths of the train B, as is shown in FIG. 5, the flip-flops 66, 67 and 68 sometimes count till four, which makes, as in Table 1, the output $Q_3$ 1 level and $\overline{Q}_3$ 0 level thereby shifting the output I of the AND gate to the 0 level as well as that of the gate 70. In this case, therefore, the sharp indicating lamp 73 is energized at longer intervals, causing some flicker, as shown in FIG. 5. The closer the tone to be tuned is to the standard, the longer becomes the interval.

If the tone is precisely tuned with the standard, the width ½T has just four cycles of the train B and the count number becomes always four, which turns off both of the lamps 73 and 74.

FIG. 6 shows a case in which the tone to be tuned is far lower than the standard. If the tone is much lower in pitch than the standard pitch, the width ½T of a pulse in the train A is made wider than 5 cycle lengths of the train B. The counting state of the flip-flops 66, 67 and 68 becomes the state of $Q_1=1$, $Q_2=0$ and $Q_3=1$ at the fifth pulse of C in a ½T width, which makes the output G of the NAND gate 65 at 0 level. Therefore, the output C of the NAND gate 64 is held at 1 level in spite of more pulses of B, locking the flip-flops 66, 67 and 68 at the state of 1 0 1. Accordingly, the output of the inverter 63 is shifted to 1 level and the output J of the AND gate 70 is shifted to 1 level in response to pulses in the train A, energizing the flat indicating lamp 72 intermittently, as is shown in FIG. 6. Thus, the flat indicating lamp 72 indicates that the tone is far lower than the standard in pitch.

If the tone is near to but a little lower in pitch than the standard and the width ½T of a pulse in the train A is wider than 4 cycle but narrower than 5 cycle lengths of the train B, as is shown in FIG. 7, the flip-flops 66, 67 and 68 count till four or till five. Four of count number in ½T width makes no effect on both the lamps 73 and 74, as described above. In this case, therefore, the flat indicating lamp 74 is energized at longer intervals, causing some flicker. The closer the tone to be tuned is to the standard, the longer becomes the interval.

The monostable multivibrator 61 resets all the flip-flops 66, 67 and 68 to the initial state synchronously with every pulse-fall in the pulse train A.

It is understandable from the above description that the flop-flop unit 66, 67 and 68 is interchangeable with a shift resister or other counter accompanying some circumferential change.

The electronic stroboscope indicator 8 has a decoder 81 which is provided with eight NAND gates 81*a*, 81*b*, 81*c* . . . 81*h*, one input terminal of each of all the gates being connected in common to the output terminal of the inverter 62 in the sharp-flat indicating circuit 6 through an inverter 814, another input terminal of each of the gates 81*a*, 81*b*, 81*c* and 81*d* being connected in common to the output terminal of the flip-flop 15*e* in the octave divider circuit 15 through an inverter 813, another input terminal of each of the gates 81*a*, 81*b*, 81*e* and 81*f* being connected in common to the output terminal of the flop-flop 15*d* through an inverter 812, another input terminal of each of the gates 81*a*, 81*c*, 81*e* and 81*g* being connected in common to the output terminal of the flip-flop 15*c* through an inverter 811, another input terminal of each of the gated 81*b*, 81*d*, 81*f* and 81*h* being connected in common to the output terminal of the inverter 811 through an inverter 815, another input terminal of each of the gates 81*c*, 81*d*, 81*g* and 81*h* being connected in common to the output terminal of the inverter 812 through an inverter 816, and further another input terminal of each of the gates 81*e*, 81*f*, 81*g* and 81*h* being connected in common to the output terminal of the inverter 813 through an inverter 817. All the NAND gates 81*a*, 81*b* . . . 81*h* are to respectively transmit signals to driver circuit 82 for driving visual indicating elements 83*a*, 83*b* . . . 83*h* arranged in a line. The visual indicating elements may be light-emitting diodes, plasma displays, Nixie tubes, liquid crystal displays or other display elements. The operation of this electronic stroboscope indicator will be described hereinafter.

Supposing the common input to each of the NAND gates 81*a*, 81*b* . . . 81*h* from the inverter 814 is removed from the decoder 81, this decoder 81 produces a sweeping signal in a manner that a 0 level output is shifted successively from one to the adjacent NAND gate among eight NAND gates 81*a*, 81*b* . . . 81*h* each of which is otherwise at 1 level, in response to input pulses to the flip-flop 15*c*, which are generated from the standard pitch. This is illustrated in Table 2, in which reference marks are in correspondence with those in FIG. 1.

Table 2

| Input Pulse No. To 15c | Inputs To Decoder 81 K | L | M | Outputs 81a | 81b | 81c | 81d | 81e | 81f | 81g | 81h |
|---|---|---|---|---|---|---|---|---|---|---|---|
| 1 | 0 | 0 | 0 | 0 | 1 | 1 | 1 | 1 | 1 | 1 | 1 |
| 2 | 1 | 0 | 0 | 1 | 0 | 1 | 1 | 1 | 1 | 1 | 1 |
| 3 | 0 | 1 | 0 | 1 | 1 | 0 | 1 | 1 | 1 | 1 | 1 |
| 4 | 1 | 1 | 0 | 1 | 1 | 1 | 0 | 1 | 1 | 1 | 1 |
| 5 | 0 | 0 | 1 | 1 | 1 | 1 | 1 | 0 | 1 | 1 | 1 |
| 6 | 1 | 0 | 1 | 1 | 1 | 1 | 1 | 1 | 0 | 1 | 1 |
| 7 | 0 | 1 | 1 | 1 | 1 | 1 | 1 | 1 | 1 | 0 | 1 |
| 8 | 1 | 1 | 1 | 1 | 1 | 1 | 1 | 1 | 1 | 1 | 0 |

The outputs of the NAND gates 81*a*, 81*b*, 81*c* . . . 81*h* are transmitted to the driver 82 and a 0 level of the output energizes the corresponding visual indicating element 83 while a 1 level causes deenergization thereof. Thus, rapid sweep indication is generated in the visual indicating elements, one sweep corresponding to eight input pulses of the flip-flop 15c. The frequency of the input pulses to the flip-flop 15c is so high that there does not occur any flicker nor light flow.

Referring to FIGS. 8 to 12, light flow indicating in the visual indicating elements 83a, 83b . . . 83h in response to a little pitch difference of the tone to be tuned from the standard pitch will be well understandable.

Figure 8:
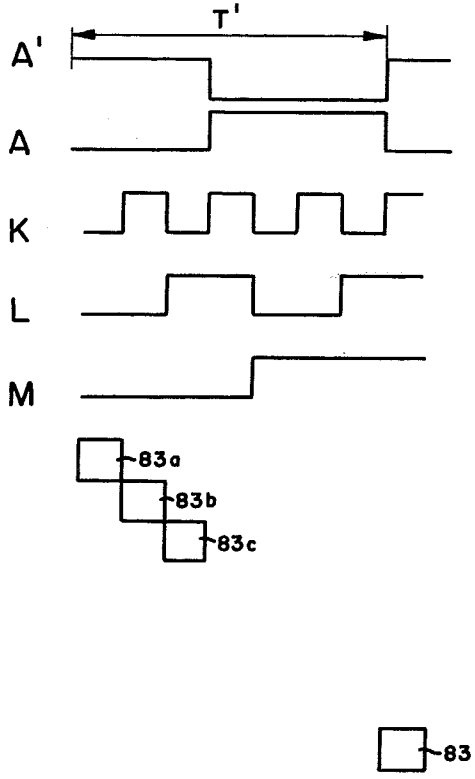
FIGS. 8 to 12 are timing charts showing electronic-stroboscope principle.
Figure 9:
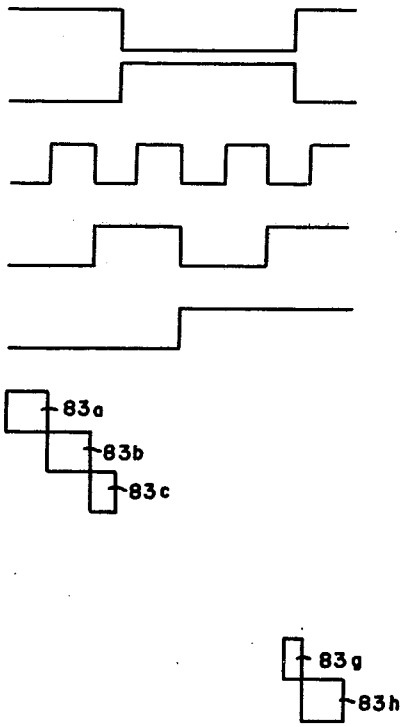
Figure 10:
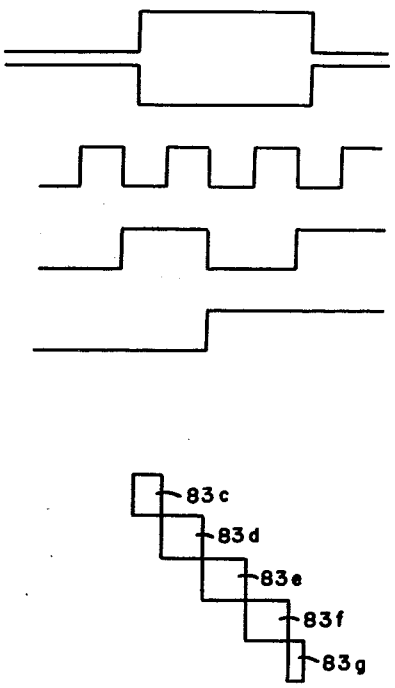

When the tone to be tuned is quite in quite coincident pitch with the standard, the output pulses of the inverter 62 are just a quarter of those of the flip-flop 15c in frequency, keeping themselves in the same phase to the pulse from flip-flop 15c. The output pulses A′ of the inverter 62 are inverted by the inverter 814 to be transmitted to all the NAND gates 81a, 81b . . . 81h simultaneously, making each output of the NAND gates 81a, 81b . . . 81h a 1 level in every 0 level in the pulse train A′. Therefore, the light sweeping is cut off at a stationary portion during 0 level of the train A′ as energizing signals of 0 level in the NAND gates 81a, 81b . . . 81h are suppressed to signals of 1 level as long as the 0 level state of the train A′ exists. Some examples of stationary cut-off state of the visual indicating elements according to the state of precise tuning are shown in FIGS. 8 to 10, wherein reference marks are in correspondence with those in FIG. 1 and in Table 2, reference A′ showing a pulse train from the inverter 62, references K, L and M respectively showing pulse trains from the flop-flops 15c, 15d and 15e, and references 83a, 83b, 83c etc. showing energized visual indicating elements. In these examples the line of visual indication stays still and does not flow.

Figure 11:
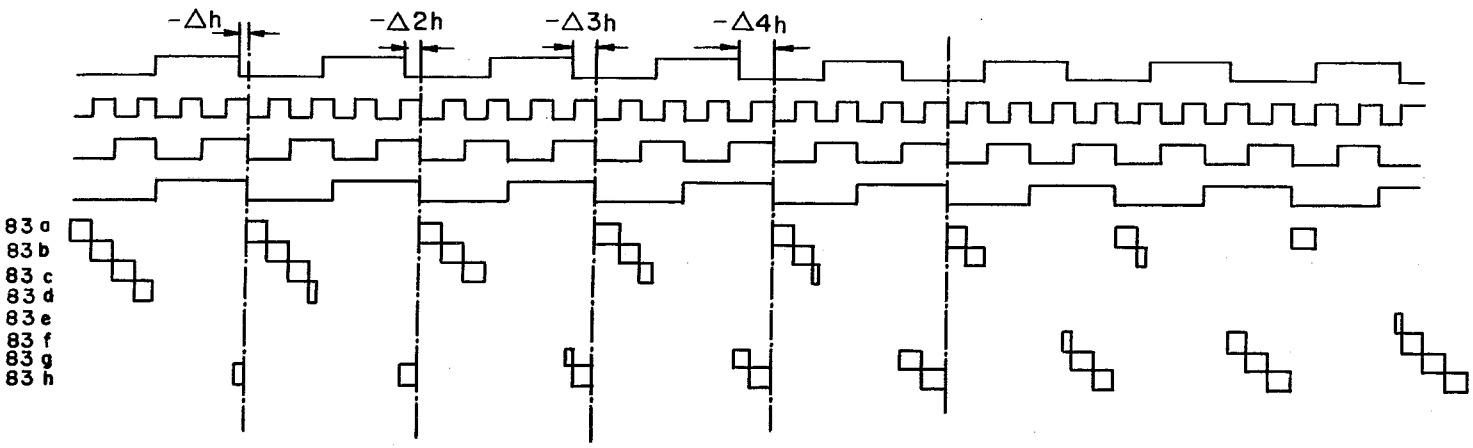

If the tone is a little higher in pitch and a cycle length of the pulse train A′ is shorter by $\Delta h$ in comparison with 4 cycle lengths of the pulse train K, deenergization of the visual indicating elements is shifted to a direction along the element line, as shown in FIG. 11, according to the discrepancy increase between the trains A′ and K. This shifting effects the visual indication line flow, and the larger the difference of the tone to be tuned from the standard, the faster the line flow speed becomes.

Figure 12:
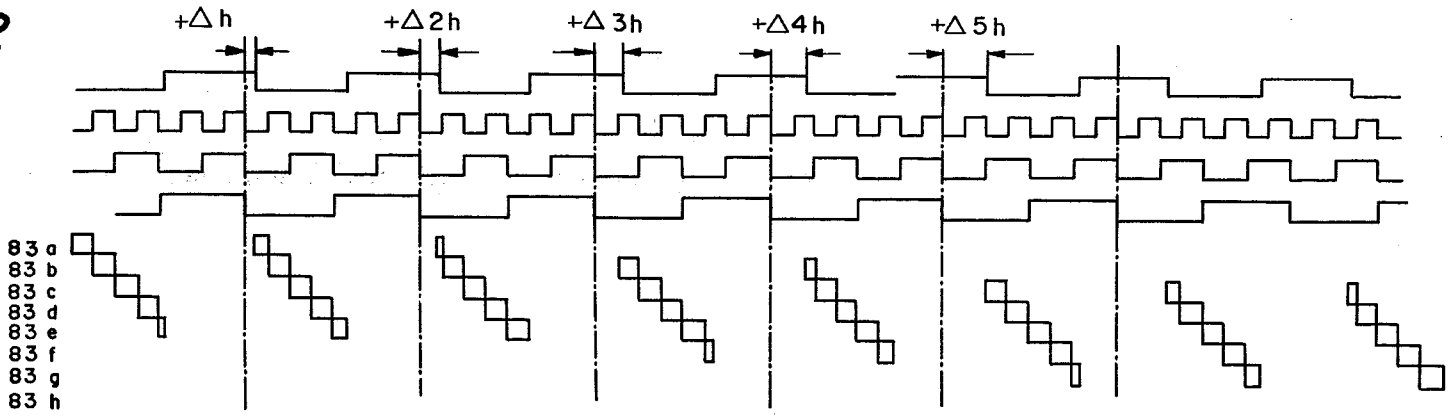

FIG. 12 is a timing chart showing a state when the tone is a little lower in pitch and a cycle length of the pulse train A′ is longer by $\Delta h$ in comparison with 4 cycle lengths of the pulse train K. In this case, the visual indication line flows in the opposite direction showing that the tone is a little lower.

The visual line flow speed is much slower. One cycle time of the flow is given as;

$$t = \frac{2^{n-1} \times 100}{aF} \text{ (sec.)}$$

In the above formula, F is the standard pitch frequency in Hz, $n$ is the ordinal number of the octave where F is situated and $a$ is deviation ratio in percent of the tone to be tuned from the standard pitch. If $a = 1\%$ and $F =$ 440Hz (i.e. deviation is 4.4Hz, $n = 4$), $t = 1.82$ sec.

It is to be noted that a very slight deviation of pitch can be detected with very slow flow speed of the visual indicating line using this electronic stroboscope indicator 8, while the sharp-flat indicating circuit 6 is suitable for rather rough tuning as is understandble from the foregoing description. That is, the tuning device having an electronic stroboscope indicator of this invention alone is suitable for professional use, but it becomes also suitable for beginner's use adding a sharp-flat indicating circuit.

What is claimed is:

1. A tuning device for tuning musical instruments or voices comprising:

a standard pitch generating circuit including a high frequency oscillator for generating high frequency pulses at a predetermined frequency, means for generating mixing pulses having a pulse width much narrower than that of the high frequency pulses and at one of a plurality of preselected frequencies, means connected to receive both the high frequency pulses and the mixing pulses for mixing them together to accordingly shift the pitch of the high frequency pulses to thereby obtain pitch-shifted pulses, a synthesizer connected to receive the pitch-shifted pulses and operative to synthesize therefrom synthesized pulses of a desired standard pitch in a higher octave, and an octave divider circuit connected to receive the synthesized pulses to divide the same into divided pulses of the standard pitch in a lower octave; a tone-electric transducing circuit including means for detecting a tone which is to be tuned and transducing the tone into a corresponding electric signal, and a trigger circuit connected to receive the electric signal to shape the same and produce a shaped tone signal; and indicating means receptive of both the divided pulses from said octave divider circuit and the shaped tone signal from said trigger circuit for providing a visual indication of the pitch difference between the two.

2. A tuning device as claimed in claim 1; wherein said indicating means includes means for providing a visual sweep signal having a sweep speed proportional to said pitch difference.

3. A tuning device as claimed in claim 2; wherein said indicating means includes an electronic stroboscope indicator having a decoder coacting with said octave divider circuit to decode the divided pulses into distributed sweep signals and including means to mask the shaped tone signal on the divided pulses to thereby generate blank portions in the sweep signals in proportion to said pitch difference, an array of light-emitting elements, and a driver circuit responsive to the sweep signals to sequentially energize said array of light-emitting elements to provide said visual sweep signal.

4. A tuning device as claimed in claim 2, further comprising a sharp-flat indicating circuit which includes a series of flip-flop circuits for counting the divided pulses from said octave divider circuit, a gate connected to receive said divided pulses and said shaped tone signal and operative to transmit the divided pulses to said series of flip-flop circuits in every gate time generated by the shaped tone signal, and a pair of drivers to energize a sharp flat mark signal or a mark signal in response to the number counted by the flip-flop circuits.

5. A tuning device as claimed in claim 2, wherein said means for generating mixing pulses includes means for generating mixing pulses at preselected frequencies at even number multiples of the ratio of the high frequency pulses to a standard pitch.

6. A tuning device as claimed in claim 5, wherein said means for generating mixing pulses includes a series of condensers, each condenser having a capacity equal to that of each other and being provided with a shift number select switch terminal on one pole thereof.

7. A tuning device as claimed in claim 5, wherein said means for generating mixing pulses comprises an oscillator.

8. A tuning device as claimed in claim 2, wherein said tone electric-pulse transducing circuit further includes a second octave divider circuit to divide the shaped tone signal into a divided octave.

9. A tuning device as claimed in claim 2, wherein said tone electric-pulse transducing circuit further includes an automatic gain controller connected before said trigger circuit to compensate the tone signal level.

10. A tuning device as claimed in claim 8, wherein said tone electric-pulse transducing circuit further includes a filter circuit to eliminate noise from the detected tone, said filter circuit passing a selected frequency signal through.

11. A tuning device as claimed in claim 2, wherein said high frequency oscillator is quartz oscillator.

12. A tuning device as claimed in claim 8, further comprising means including a set of selecting switchs for choosing a desired octave, said switches selecting dividing steps in the second divider circuit, thereby making the output frequency always in a predetermined octave.

13. A tuning device as claimed in claim 10, further comprising two-coacting selecting switches for choosing a desired octave, one of said switches selecting dividing steps in said second divider circuit, and the other changing the filter band or cut-off frequency of said filter circuit in response to the selected octave.

14. A tuning device as claimed in claim 2, further comprising an audible tone generator and a set of select switches to select an output step from said octave divider circuit according to a desired octave and transmitting the output to said tone generator.

* * * * *